US008389190B2

(12) United States Patent
Kim et al.

(10) Patent No.: US 8,389,190 B2
(45) **Date of Patent: *Mar. 5, 2013**

(54) TONER FOR DEVELOPING ELECTROSTATIC LATENT IMAGE AND METHOD OF PREPARING THE TONER

(75) Inventors: Jae-Hwan Kim, Seoul (KR); Jun-Young Lee, Seoul (KR); Yo-Da Shin, Incheon (KR); Tae-Hoe Koo, Seoul (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 484 days.

This patent is subject to a terminal disclaimer.

(21) Appl. No.: 12/603,132

(22) Filed: Oct. 21, 2009

(65) Prior Publication Data

US 2010/0151376 A1 Jun. 17, 2010

(30) Foreign Application Priority Data

Dec. 17, 2008 (KR) ..... 10-2008-0128619

(51) Int. Cl.
*G03G 9/00* (2006.01)

(52) U.S. Cl. ..... 430/110.3; 430/107.1; 430/108.24; 430/108.8

(58) Field of Classification Search ..... 430/110.3, 430/107.1, 108.24, 108.8
See application file for complete search history.

(56) References Cited

U.S. PATENT DOCUMENTS

2006/0283806 A1* 12/2006 Kojima et al. ..... 210/725
2007/0087281 A1* 4/2007 Patel et al. ..... 430/110.2

* cited by examiner

*Primary Examiner* — Thorl Chea
(74) *Attorney, Agent, or Firm* — Stanzione & Kim, LLP

(57) ABSTRACT

Disclosed are a toner for developing an electrostatic latent image and a method of preparing the toner. The toner may include a latex, a colorant and a releasing agent, and may further include sulfur (S), iron (Fe) and silicon (Si). The [S]/[Fe] ratio may be within the range between about $5.0\times10^{-4}$ and about $5.0\times10^{-2}$. The [Si]/[Fe] ratio may be within the range of between about $5.0\times10^{-4}$ and about $5.0\times10^{-2}$. [S], [Fe] and [Si] are the amounts of S, Fe and Si measured by X-ray fluorescence spectrometry, respectively.

7 Claims, 2 Drawing Sheets

TONER FOR DEVELOPING ELECTROSTATIC LATENT IMAGE AND METHOD OF PREPARING THE TONER

CROSS-REFERENCE TO RELATED PATENT APPLICATION

This application claims the benefit of Korean Patent Application No. 10-2008-0128619, filed on Dec. 17, 2008 in the Korean Intellectual Property Office, the disclosure of which is hereby incorporated by reference in its entirety for all purposes.

TECHNICAL FIELD

The present disclosure generally relates to toner for developing an electrostatic latent image and methods of preparing the toner.

BACKGROUND OF RELATED ART

For electrophotographic processes or electrostatic recording process, developers that visualize electrostatic images or electrostatic latent images may be classified into two-component developers and one-component developers. Two-component developers are composed of toner and carrier particles; whereas one-component developers are substantially composed of only toner. That is, one-component developers do not use carrier particles. One-component developers may be further classified into magnetic developers and nonmagnetic developers, in which magnetic developers contain a magnetic component while nonmagnetic developers do not. In addition, fluiding agents may be added to nonmagnetic one-component developers in order to improve the fluidity of the toner. Examples of fluiding agents include, but are not limited to, colloidal silica and the like.

In general, toners contain colored particles, which may be obtained by dispersing a pigment such as carbon black or other additives in latex. These toner may be prepared using a grinding method (sometimes also referred to as a pulverizing method) or a polymerizing method. In the grinding method, a synthesized resin, a colorant and optionally other additives are dissolved and mixed together. The resulting mixture is ground. The particles resulting from the grinding or pulverization are classified or sorted in order to obtain particles having a desired diameter. In the polymerizing method, a polymerizable monomer, a colorant, a polymerization initiator and optionally other additives, such as, for example, a crosslinking agent or an antistatic agent, are homogeneously dissolved together or are dispersed to form a polymerizable monomer composition. The polymerizable monomer composition may be dispersed with an agitator in an aqueous dispersion medium containing a dispersion stabilizer so as to form droplet particles of the composition. The temperature of the composition may be increased and a suspension-polymerization process may be performed on the composition to obtain color polymerization particles having the desired particle diameters, that is, the desired polymerization toner.

Toner for developing an electrostatic latent image described above may contain impurities, which may be the source of an unpleasant odor. For example, aromatic impurities having low molecular weights may generate an unpleasant odor when the toner is used or when a packaged toner is open.

Toner may be fixed to a surface of a medium (e.g., a sheet of paper) through the use of a fixing method. For example, fixing methods include methods such as a compression fixing method, a heat fixing method, or a combination thereof. Examples of the heat fixing method include an oven fixing method, a flash fixing method, and a heating roller fixing method. The heating roller fixing method is widely used in electrophotographic copiers and printers. When a toner image on a medium is fused onto a surface of a the medium by using the heating roller fixing method, the toner image can be quickly fixed with high thermal efficiency. In particular, the heating roller fixing method is very useful for high-speed copying and printing.

Since the heating roller fixing method includes heating of the toner, small amounts of materials contained in the toner may also be discharged into the surrounding atmosphere resulting in an unpleasant odor. With the reductions in the sizes of copiers and printers, they use in an office or home setting has become more prevalent, increasing the likelihood of a user being exposed to the unpleasant odor generated from toner. The human sense of smell may be as low as 0.1 ppm or less.

The unpleasant odor induced from toner may be reduced by decreasing the impurities, for example, contained in the binder resin. For example, the unpleasant odor may be reduced by decreasing the monomer residue in the binder resin of the toner. The oxidation product of benzaldehyde contained in toner has also been reported as a source of an unpleasant odor. Accordingly, there have been many efforts made in an attempt to reduce the amount of benzaldehyde present in toner. In addition, much research has been conducted into the feasibility of adding to toner a material that reacts with or adsorbs the unpleasant odor. For example, these materials include but are not limited to an alkyl betaine compound, catechin, and metal phthalocyanine. However, there is still a need to develop toner that generates less of an unpleasant odor while maintaining the other desirable properties of the toner.

SUMMARY OF THE DISCLOSURE

According to an aspect of the present disclosure, there is provided a toner that may comprise a latex, a colorant and a releasing agent, and that may further include sulfur (S), iron (Fe) and silicon (Si). The [S]/[Fe] ratio may be from about $5.0\times10^{-4}$ to about $5.0\times10^{-2}$. The [Si]/[Fe] ratio may be from about $5.0\times10^{-4}$ to about $5.0\times10^{-2}$. [S], [Fe] and [Si] denote the amounts of S, Fe and Si, respectively, each measured using an X-ray fluorescence spectrometry.

Each of the [S] and the [Fe] may be in the range of about 3 to about 30,000 ppm.

The releasing agent may comprise a mixture of a paraffin-based wax with one of an ester-based wax; or an ester group-containing paraffin-based wax.

The releasing agent may for example comprise a mixture of a paraffin-based wax and an ester-based wax. The amount of the ester-based wax may be in the range of about 5 to about 39 parts by weight % based on the total weight of the releasing agent.

The toner may have an average particle diameter in the range of about 3 to about 8 μm.

The toner may have an average circularity in the range of about 0.940 to about 0.990.

The toner may have a volume average particle diameter distribution coefficient (GSDv) of about 1.30 or less and a number average particle diameter distribution coefficient (GSDp) of about 1.30 or less.

According to another aspect of the present disclosure, a method of preparing a toner may be provided to include the steps of: mixing a primary latex particle, a colorant dispersion and a releasing agent dispersion to form a mixed solution; adding an agglomerating agent to the mixed solution to form a primary agglomerated toner; and coating the primary agglomerated toner with a secondary latex to form a secondary agglomerated toner, the secondary latex being prepared by polymerizing at least one polymerizable monomer on the primary agglomerated toner. The toner may comprise S, Fe and Si. The [S]/[Fe] ratio may be in the range of about $5.0\times10^{-4}$ to about $5.0\times10^{-2}$. The [Si]/[Fe] ratio may be in the range of about $5.0\times10^{-4}$ to about $5.0\times10^{-2}$. [S], [Fe] and [Si] may be respectively the amounts of S, Fe and Si as measured using an X-ray fluorescence spectrometry.

The primary latex particle may comprise polyester, a polymer formed by polymerizing at least one polymerizable monomer, or a mixture thereof.

The method may further comprise coating the secondary agglomerated toner with a tertiary latex. The tertiary latex may be prepared by polymerizing at least one polymerizable monomer on the secondary agglomerated toner.

The at least one polymerizable monomer may comprise at least one monomer selected from styrene-based monomers, acrylic acids, methacrylic acid, derivatives of (meth)acrylic acids, ethylenically unsaturated monoolefines, halogenated vinyls, vinyl esters, vinyl ethers, vinyl ketones and nitrogen-containing vinyl compounds.

The releasing agent dispersion may comprise a mixture of a paraffin-based wax with an ester-based wax; or an ester group-containing paraffin-based wax.

The agglomerating agent may comprises a Si and Fe containing metal salt.

The agglomerating agent may comprise polysilica iron.

The agglomerating agent may be added to the mixed solution at a pH level in the range of about 0.1 to about 2.0.

According to yet another aspect of the present disclosure, a method of forming an image may be provided to include the steps of attaching toner to a surface of a photoreceptor on which an electrostatic latent image is formed so as to form a visible image; and transferring the visible image onto a print medium. The toner may comprise a latex, a colorant and a releasing agent, and may further include sulfur (S), iron (Fe) and silicon (Si). The [S]/[Fe] ratio may be from about $5.0\times10^{-4}$ to about $5.0\times10^{-2}$. The [Si]/[Fe] ratio may be from about $5.0\times10^{-4}$ to about $5.0\times10^{-2}$. [S], [Fe] and [Si] denote the amounts of S, Fe and Si, respectively, each measured using an X-ray fluorescence spectrometry.

According even yet another aspect of the present disclosure, a toner supplying apparatus may be provided to include a toner tank and a supplying part. The toner tank may define a volume into which to receive a supply of toner. The supplying part may be arranged to project into the volume defined by the toner tank, and may have a toner outlet through which toner is discharge out of the toner tank. The toner may comprise a latex, a colorant and a releasing agent, and may further include sulfur (S), iron (Fe) and silicon (Si). The [S]/[Fe] ratio may be from about $5.0\times10^{-4}$ to about $5.0\times10^{-2}$. The [Si]/[Fe] ratio may be from about $5.0\times10^{-4}$ to about $5.0\times10^{-2}$. [S], [Fe] and [Si] denote the amounts of S, Fe and Si, respectively, each measured using an X-ray fluorescence spectrometry.

The toner supplying apparatus may further comprise a toner agitating member rotatably disposed inside the toner tank to cause a movement of toner within the toner tank. The toner agitating member may be of such shape and size so as to be capable of causing the movement of toner located on a top surface of the supplying part.

The toner agitating member may comprise a rotational shaft about which the agitating member rotates and a film extending radially outward from the rotational shaft. The film may be divided into first and second sections, the first section of the film being configured come into an interfering contact with the top surface of the supplying part and being bendable responsive to the interfering contact independently of the second section.

According to still yet another aspect of the present disclosure, an image forming apparatus may be provided to comprise an image carrier, a toner supplying unit and a toner transferring unit. The image carrier may have a surface capable of supporting thereon an electrostatic latent image. The toner supplying unit may be configured to supply toner onto the surface of the image carrier to thereby develop the electrostatic latent image into a toner image. The toner transferring unit may be configured to transfer the toner image from the surface of the image carrier to a print medium. The toner may comprise a latex, a colorant and a releasing agent, and may further include sulfur (S), iron (Fe) and silicon (Si). The [S]/[Fe] ratio may be from about $5.0\times10^{-4}$ to about $5.0\times10^{-2}$. The [Si]/[Fe] ratio may be from about $5.0\times10^{-4}$ to about $5.0\times10^{-2}$. [S], [Fe] and [Si] denote the amounts of S, Fe and Si, respectively, each measured using an X-ray fluorescence spectrometry.

BRIEF DESCRIPTION OF THE DRAWINGS

Various features and advantages of the present disclosure will become more apparent by describing in detail exemplary embodiments thereof with reference to the attached drawings in which.

DETAILED DESCRIPTION OF THE DISCLOSURE

Figure 1:
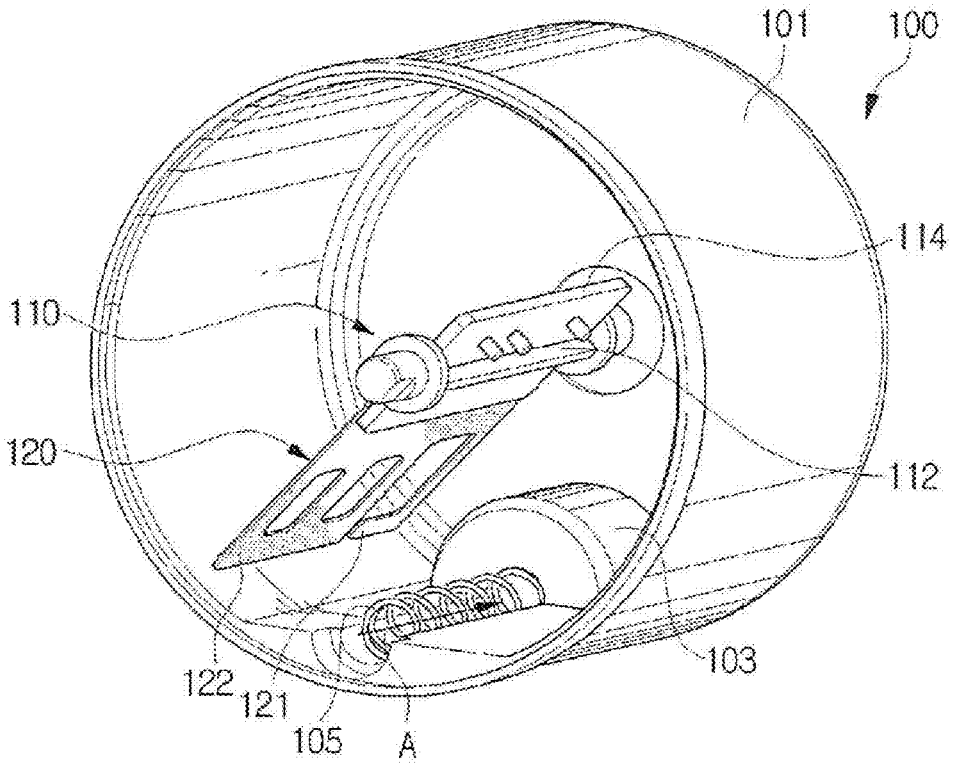
FIG. 1 is a perspective view of a toner supplying unit according to an embodiment of the present disclosure.

The present disclosure will now be described more fully with reference to the accompanying drawings, in which exemplary embodiments of the present disclosure are shown.

According to the present disclosure, toner for developing an electrostatic latent image may include latex, a colorant and a releasing agent, and may further include sulfur (S), iron (Fe) and silicon (Si). The [S]/[Fe] ratio may be from about $5.0\times10^{-4}$ to about $5.0\times10^{-2}$. The [Si]/[Fe] ratio may be from about $5.0\times10^{-4}$ to about $5.0\times10^{-2}$. [S], [Fe] and [Si] denote the amounts of S, Fe and Si, respectively, measured by an X-ray fluorescence spectrometry.

According to an embodiment, the [S] may correspond to the amount of S contained in an S-containing compound, which may act as a chain transfer agent for adjusting a latex molecular distribution when the latex is prepared.

According to an embodiment, the [Fe] may correspond to the amount of Fe contained in an agglomerating agent, which may be used to agglomerate the latex, the colorant and the releasing agent when the toner is being prepared. Thus, the [Fe] may affect the agglomeration properties, particle distribution, and/or the particle size of agglomerated toner. In this regard, the agglomerated toner may be a precursor for preparing the final toner.

According to an embodiment, the [Si] may correspond to the sum of the amount of Si contained in polysilica contained in an agglomerating agent and/or the amount of Si contained in silica that is externally added to secure the flowability of toner. Thus, the [Si] may affect the agglomeration properties, particle distribution, and/or the particle size of the agglomerated toner as well as the flowability of the toner.

According to an embodiment, the [S]/[Fe] ratio may be, for example, from about $5.0\times10^{-4}$ to about $5.0\times10^{-2}$, or from about $8.0\times10^{-4}$ to about $3.0\times10^{-2}$, or from about $1.0\times10^{-3}$ to about $1.0\times10^{-2}$. If the [S]/[Fe] ratio is within these ranges, and the molecular weight and the degree of agglomeration are appropriately controlled, the desired particle size and particle size distribution may be obtained while less unpleasant odor may be generated. If the [Si]/[Fe] ratio is within these ranges, the flowability of the toner may be increased, and the inside of the printer may also be protected from contamination.

According to an aspect of the present disclosure, there is provided a method of preparing a toner for developing an electrostatic latent image, which may include the steps of a) mixing a primary latex particle, a colorant dispersion and a releasing agent dispersion to provide a mixed solution; b) adding an agglomerating agent to the mixed solution to prepare a primary agglomerated toner; c) coating the primary agglomerated toner with a secondary latex to prepare a secondary agglomerated toner. The secondary latex may be prepared by polymerizing at least one polymerizable monomer. The toner may include S, Fe, and Si. The [S]/[Fe] ratio may be in the range from about $5.0\times10^{-4}$ to about $5.0\times10^{-2}$. The [Si]/[Fe] ratio may be from about $5.0\times10^{-4}$ to about $5.0\times10^{-2}$. The [S], [Fe] and [Si] denote the amount of S measured by X-ray fluorescence spectrometry, the amount of Fe measured by X-ray fluorescence spectrometry and the amount of Si measured by X-ray fluorescence spectrometry, respectively.

Examples of the agglomerating agent include but are not limited to NaCl, $MgCl_2$, $MgCl_2.8H_20$, $[Al_2(OH)_nCl_{6-n}]_m$ ($Al_2(SO_4)_3.18H_2O$), polyaluminum chloride (PAC), polyaluminum sulfate (PAS), polyaluminum sulfate silicate (PASS), ferrous sulfate, ferric sulfate, ferric chloride, calcium hydroxide, calcium carbonate and Si and/or Fe-containing metal salts, and the like. However, the agglomerating agent is not limited to these examples.

The amount of the agglomerating agent may be, for example, from about 0.1 to about 10 parts by weight, or from about 0.5 to about 8 parts by weight, or from about 1 to about 6 parts by weight, based on 100 parts by weight of the primary latex particle. If the amount of the agglomerating agent is within these ranges, the agglomeration effect and toner particle size distribution may advantageously be improved, the chargeability of the toner may be improved, and/or the internal contamination of the printer may be reduced.

According to an embodiment of the method of preparing toner for developing an electrostatic latent image, the agglomerating agent may be a Si and/or Fe containing metal salt. The amount of each of Si and Fe may be, for example, from about 3 to about 30,000 ppm, or from about 30 to about 25,000 ppm, or from about 300 to about 20,000 ppm. If the amount of each of Si and Fe are within these ranges, the chargeability of the toner may be improved, and/or the internal contamination of the printer may be reduced.

The Si and Fe containing metal salt may include, for example, polysilica iron. Due to the increased ionic strength of the toner by adding the Si and Fe containing metal salts, the size of the primary agglomerated toner may be increased. The Si and Fe containing metal salt may also be, for example, polysilicate iron. Available examples of the Si and Fe containing metal salts include but are not limited to PSI-025, PSI-050, PSI-075, PSI-100, PSI-200, and PSI-300, and the like (available from Suido Kiko Kaisha, Ltd. of Tokyo, Japan).

Table 1 shows the physical properties and compositions of PSI-025, PSI-050, PSI-075, PSI-100, PSI-200, and PSI-300.

TABLE 1

| Type | | PSI-025 | PSI-050 | PSI-085 | PSI-100 | PSI-200 | PSI-300 |
|---|---|---|---|---|---|---|---|
| Silica/Fe mole ratio (Si/Fe) | | 0.25 | 0.5 | 0.85 | 1 | 2 | 3 |
| Main component concentration | Fe (wt %) | 5.0 | 3.5 | 2.5 | 2.0 | 1.0 | 0.7 |
| | SiO2 (wt %) | 1.4 | 1.9 | 2.0 | | 2.2 | |
| pH(1 w/v %) | | 2-3 | | | | | |
| Specific gravity (20° C.) | | 1.14 | 1.13 | 1.09 | 1.08 | 1.06 | 1.04 |
| Viscosity (mPa · S) | | 2.0 or more | | | | | |
| Average molecular weight (Dalton) | | 500,000 | | | | | |
| External appearance | | Yellowish brown transparent liquid | | | | | |

The use of a Si and Fe-containing metal salts as an agglomerating agent according to an embodiment of the methods for preparing an electrophotographic toner, allows for the reduction in size of the toner particles as well as control over the shape of the particles.

According to an embodiment, the agglomerating agent having a pH level that ranges from about 0.1 to about 2.0, or from about 0.3 to about 1.8, or from about 0.5 to about 1.6, may be used. When an agglomerating agent having the pH level that is within the above ranges is added, then the handing efficiency may be increased, the unpleasant odor may be controlled, and/or the agglomeration efficiency may be increased.

According to an embodiment of the present disclosure, the volume average particle diameter distribution coefficient of the toner may be, for example, from about 3 to about 8 μm, or from about 4 to about 7.5 μm, or from about 4.5 to about 7 μm; and the average circularity of the toner may be, for example, from about 0.940 to about 0.990, or from about 0.945 to about 0.985, or from about 0.950 to about 0.980.

In general, the smaller the toner particle size is, the higher the resolution and the higher the image quality of an image may be. However, when the transfer speed and the necessary cleaning force are taken into consideration, an excessively small toner particle size may not be desirable. Thus, it may be important to have an appropriate toner particle size for an optimal performance.

The volume average particle diameter of the toner may be measured by electrical impedance analysis, for example. If the volume average particle diameter of the toner is kept within the range described above, it may be easier to clean the photoreceptor, the toner particles may be charged with an improved uniformity, the toner particles may be less likely to adhere together into lumps, and it may thus be easier to regulate the toner layer, e.g., using a doctor blade, any one of which improvements may contribute in enabling higher resolution and/or quality images. In addition, with the volume average particle diameter of the toner being within the above described ranges, the production yield may also increase during mass-production of the toner.

If the average circularity of the disclosed toner is within the range described above, since the image developed on the transfer medium may have a sufficient coverage ratio, a lesser amount of toner consumption may be required in order to obtain a desired image concentration. Further, occurrences of non-uniformity in the toner layer coating the development sleeve due to an excessive amount of toner being supplied onto the sleeve may also be reduced.

The circularity of the toner can be measured, for example according to an embodiment, using a SYSMEX FPIA-3000 (available from Sysmex Corporation of Kobe, Japan) according to the following equation:

$$\text{Circularity}=2\times(\pi\times\text{area})^{0.5}/\text{circumference}.$$

The circularity may be from 0 to 1. As the circularity approaches 1, the toner particle shape becomes more circular.

The toner particle distribution coefficient may be a volume average particle diameter distribution coefficient GSDv or a number average particle diameter distribution coefficient GSDp. The GSDv and the GSDp may be measured in the following manner.

First, a toner particle diameter distribution may be obtained using toner particle diameters measured using a Multisizer III (available from Beckman Coulter Inc. of Fullerton, Calif., U.S.A.). The toner particle diameter distribution is divided at predetermined particle diameter ranges (channels). With respect to the respective divided particle diameter ranges (channels), the cumulative volume distribution of toner particles and the cumulative number distribution of toner particles are measured, wherein, in each of the cumulative volume and number distributions, the particle size in each distribution is increased in a direction from the left to the right. A particle diameter at 16% of the respective cumulative distributions is defined as a volume average particle diameter D16*v* and a number average particle diameter D16*p*, respectively. A particle diameter at 50% of the respective cumulative distributions is defined as a volume average particle diameter D50*v* and a number average particle diameter D50*p*, respectively. A particle diameter at 84% of the respective cumulative distributions is defined as a volume average particle diameter D84*v* and a number average particle diameter D84*p*.

In this case, GSDv is defined as $(D84v/D16v)^{0.5}$, and GSDp is defined as $(D84p/D16p)^{0.5}$. In this regard, the GSDv and GSDp is each, for example, from about 1.30 or less, or about 1.15 to about 1.30, or about 1.20 to about 1.25. If the GSDv and GSDp is within the ranges described above, the toner particle diameters may be uniform.

In the method of preparing a toner according to an embodiment, the primary latex may be polyester, a polymer prepared by polymerizing at least one polymerizable monomer, or a mixture thereof (hybrid). When the primary latex is a polymer, at least one polymerizable monomer may be polymerized together with a releasing agent such as wax in the polymerizing process, or the polymer may be mixed with the releasing agent.

The polymerizing process may be an emulsion polymerization distribution process. As a result of the emulsion polymerization distribution process, the primary latex particles may have a particle size of about 1 μM or less, for example, or from about 100 to about 300 nm, or from about 150 to about 250 nm.

The polymerizable monomer used herein may include at least one monomer such as styrene, vinyl toluene, or α-methylstyrene; acrylic acids, methacrylic acids; derivatives of (meth)acrylic acid such as methyl acrylate, ethyl acrylate, propyl acrylate, butyl acrylate, 2-ethylhexyl acrylate, dimethylaminoethyl acrylate, methyl methacrylate, ethyl methacrylate, propyl methacrylate, butyl methacrylate, 2-ethylhexyl methacrylate, dimethylaminoethyl methacrylate, acrylonitrile, methacrylonitrile, acrylamide, or methacrylamide; ethylenically unsaturated monoolefines such as ethylene, propylene, or butylene; halogenated vinyls such as vinyl chloride, vinylidene chloride, or vinyl fluoride; vinyl esters such as vinyl acetate or vinyl propionate; vinyl ethers such as vinyl methyl ether or vinyl ethyl ether; vinyl ketones such as vinyl methyl ketone or methyl isoprophenyl ketone; and a nitrogen-containing vinyl compound such as 2-vinyl-pyridine, 4-vinyl-pyridine, or N-vinyl-pyrrolidone, and the like.

When the primary latex particle is manufactured, a polymerization initiator and a chain transfer agent may be further used to efficiently perform the polymerization process.

Examples of the polymerization initiator may include persulfates such as potassium persulfate or ammonium persulfate; azo compounds such as 4,4-azobis(4-cyano valeric acid), dimethyl-2,2'-azobis(2-methylpropionate), 2,2-azobis(2-amidinopropane)dihydrochloride, 2,2-azobis-2-methyl-N-1,1-bis(hydroxymethyl)-2-hydroxyethylpropioamide, 2,2'-azobis(2,4-dimethylvaleronitrile), 2,2'-azobisisobutyronitrile, or 1,1'-azobis(1-cyclohexancarbonitrile); and peroxides such as methylethylperoxide, di-t-butylperoxide, acetylperoxide, dikumylperoxide, lauroylperoxide, benzoylperoxide, t-butylperoxy-2-ethylhexanoate, di-isopropylperoxydicarbonate, or di-t-butylperoxyisophthalate, and the like. In addition, oxidation-reduction initiators prepared by combining these polymerization initiators and reductants may also be used as the polymerization initiator.

The chain transfer agent refers to a material that changes the type of a chain carrier when a chain reaction occurs. The chain transfer agent includes a material that induces new chain activity to be substantially weaker than the existing chain activity. Due to the chain transfer agent, a polymerization degree of polymerizable monomers may be reduced so that a novel chain reaction may be initiated. Owing to the chain transfer agent, the molecular weight distributions of the polymer may be better controlled.

The amount of the chain transfer agent may be, for example, from about 0.1 to about 5 parts by weight, or from about 0.2 to about 3 parts by weight, or from about 0.5 to about 2.0 parts by weight, based on 100 parts by weight of the at least one polymerizable monomer. If the amount of the chain transfer agent is within these ranges, the molecular weight of the polymer may be appropriately controlled, and the agglomeration efficiency and fixing performance may be increased.

Examples of the chain transfer agent include sulfur-containing compounds such as dodecanethiol, thioglycolic acid, thioacetic acid, or mercaptoethanol; phosphorous acid compounds such as a phosphorous acid or sodium phosphorous acid; hypophosphorous acid compounds such as a hypophosphorous acid or a sodium hypophosphorous acid; and alcohols such as methylalcohols, ethylalcohols, isopropylalcohols, and n-butylalcohols, and the like. However, the chain transfer agent is not limited to those materials.

The primary latex particle may further include a charge controller. The charge controller may stably support toner on a development roller with an electrostatic force. Thus, by using the charge controller, stable and high charging speeds may be obtained. The charge controller used in one or more embodiments of the present disclosure may be a negatively charged charge controller or a positively charged charge controller. Examples of the negatively charged charge controller may include, but are not limited to, an organic metal complex such as a chrominum-containing azo complex or a monoazo metal complex, or chelate compounds; metal-containing salicylic acid compounds, wherein the metal may be chrominum, iron, or zinc; and organic metal complexes such as aromatic hydroxycarboxylic acids or an aromatic dicarboxylic acid. However, the negatively charged charge controller is not limited to this list. Examples of the positively charged charge controller may include, but are not limited to, a modified product such as nigrosine and a fatty acid metal salt thereof and an onium salt including a quaternary ammonium salt such as tributylammonium 1-hydroxy-4-naphthosulfonate and tetrabutylammonium tetrafluoroborate. The negative and positively charged controllers may be used alone or in combination.

The primary latex particle obtained as described above may be mixed with the colorant dispersion and the releasing agent dispersion to prepare a mixed solution. The colorant dispersion may be obtained by uniformly dispersing a composition including a colorant, such as a black colorant, a cyan colorant, a magenta colorant, or a yellow colorant, and an emulsifier by using an ultrasonic homogenizer or a micro fluidizer.

Among colorants used to prepare the colorant dispersion, the black colorant may be a carbon black or aniline black. For color toner, at least one colorant may be selected from cyan colorant, magenta colorant, and yellow colorant, which may be used in addition to the black colorant.

The yellow colorant may be a condensation nitrogen compound, an isoindolinone compound, an anthraquine compound, an azo metal complex, or an alyl imide compound. Examples of the yellow colorant include C.I. pigment yellows 12, 13, 14, 17, 62, 74, 83, 93, 94, 95, 109, 110, 111, 128, 129, 147, 168, and 180.

Examples of the magenta colorant include condensation nitrogen compounds, anthraquine compounds, quinacridone compounds, base dye rate compounds, naphthol compounds, benzo imidazole compounds, thioindigo compounds, and perylene compounds. Specifically, examples of the magenta colorant include C.I. pigment reds 2, 3, 5, 6, 7, 23, 48:2, 48:3, 48:4, 57:1, 81:1, 122, 144, 146, 166, 169, 177, 184, 185, 202, 206, 220, 221, and 254.

Examples of the cyan colorant include but are not limited to copper phthalocyanie compounds and derivatives thereof, anthraquine compounds, and base dye rate compounds. Specifically, examples of the cyan colorant include but are not limited to C.I. pigment blues 1, 7, 15, 15:1, 15:2, 15:3, 15:4, 60, 62, and 66.

These colorants may be used alone or in combination, and may be selected in consideration of one or more of color, chroma, brightness, weather resistance, dispersibility in toner, and the like.

The amount of the colorant used to prepare the colorant dispersion may be, for example, from about 0.5 to about 15 parts by weight, or about 1 to about 12 parts by weight, or about 2 to about 10 parts by weight, based on 100 parts by weight of the toner. If the colorant used to prepare the colorant dispersion is within these ranges, a suitable coloring effect as well as sufficient electrification may be obtained.

The emulsifier used to prepare the colorant dispersion may be any known emulsifier. For example, the emulsifier may be an anionic reactive emulsifier, a non-ionic reactive emulsifier, or a mixture thereof. The anionic reactive emulsifier may be, for example, HS-10 (available from Dai-Ichi Kogyo Seiyaku Co., Ltd. of Tokyo, Japan) or Dowfax® 2A1 (available from Rhodia Inc. of NJ, U.S.A.). The non-ionic reactive emulsifier may be RN-10 (manufactured by Dai-Ichi Kogyo Seiyaku Co., Ltd.).

According to an embodiment, the releasing agent dispersion that may be used in the preparation of the toner may include a releasing agent, water, or an emulsifier. The releasing agent may enable the toner to be fixed to a final image receptor at a suitably low fixing temperature with desirable final image durability and abrasion-resistance characteristics. Thus, the desirable characteristics of toner may be dependent upon the type and amount of the releasing agent.

Examples of an available releasing agent may include, for example, polyethylene-based wax, polypropylene-based wax, silicon wax, paraffin-based wax, ester-based wax, carnauba wax, or metallocene wax. The melting point of the releasing agent may be, for example, from about 50 to about 150° C. The releasing agent may be physically attached to the toner particles, but may not be covalently bound to the toner particles.

The amount of the releasing agent may be from about 1 to about 20 parts by weight, or about 2 to about 16 parts by weight, or about 3 to about 12 parts by weight, based on 100 parts by weight of the toner. If the amount of the releasing agent is within these ranges, the low-temperature fixing performance and low-temperature characteristics of the toner may be improved. If the fixing temperature range is sufficiently large, the costs of storage and/or the manufacture may be higher.

The releasing agent may be an ester group-containing wax. Examples of the ester group-containing wax may include, but are not limited to, (1) mixtures including ester-based wax and non-ester based wax; and (2) an ester group-containing wax prepared by adding an ester group to a non-ester based wax.

Since an ester group may have high affinity with respect to the latex component of toner, wax can be uniformly distributed among the toner particles, thus realizing an effective benefit of the use of such wax. If however only the ester-based wax is used, excessive plasticizing reactions may occur. Thus, the inclusion of the non-ester based wax may result in prevention of such excessive plasticizing reactions due to its releasing reaction with respect to the latex. With such a releasing agent of the above described configurations, the intended development characteristics of toner may be maintained for a longer period of time.

Examples of the ester-based wax may include, but are not limited to, esters of C15-C30 fatty acids and 1 to 5 valence alcohols, such as behenic acid behenyl, staric acid stearyl, stearic acid ester of pentaeritritol, or montanic acid glyceride. Also, if the alcohol component that forms the ester is a monovalent alcohol, the number of carbon atoms may be from about 10 to 30, and if the alcohol component that forms ester is a polymeric alcohol, the number of carbon atoms may be from about 3 to about 10.

The non-ester based wax may be, for example, polymethylene-based wax or paraffin-based wax. Examples of the ester group-containing wax may include, but are not limited to, mixtures including paraffin-based wax and ester based wax; and ester group-containing paraffin-based wax. Examples of the ester group-containing wax may include, but are not limited to, P-280, P-318 and P-319 (each available from Chukyo Yushi Co., Ltd. Of Nagoya, Japan).

If the releasing agent is a mixture including a paraffin-based wax and an ester based wax, the amount of the ester-based wax of the releasing agent may be, for example, from about 5 to about 39 weight %, or about 7 to about 36 weight %, or about 9 to about 33 weight. %, based on the total weight of the releasing agent. If the amount of the ester-base wax is within these ranges, the compatibility of the ester-based wax with respect to the primary latex particle may be improved. In addition, the plasticizing characteristics of the toner may be appropriately controlled and/or the toner may be capable of retaining the proper development characteristics for a longer period of time.

Similarly with the emulsifier used in the colorant dispersion, the emulsifier used in the releasing agent dispersion may be any known emulsifier, examples of which may include, but are not limited to, an anionic reactive emulsifier, a non-ionic reactive emulsifier, and mixtures thereof. The anionic reactive emulsifier may be, for example, HS-10 (available from Dai-Ichi Kogyo Seiyaku Co., Ltd. of Tokyo, Japan) or Dowfax® 2A1 (available from Rhodia Inc. of NJ, U.S.A.). The non-ionic reactive emulsifier may be RN-10 (manufactured by Dai-Ichi Kogyo Seiyaku Co., Ltd.).

According to an embodiment, in preparation of the toner, the molecular weight, $T_g$, and rheological characteristics of the primary latex particles may be appropriately controlled in such a way that the toner can be fixed at low temperature.

The primary latex particles, the colorant dispersion and the releasing agent dispersion as described herein may be mixed to obtain a mixed solution, to which mixed solution an agglomerating agent may be added to thereby obtaining an agglomerated toner. For example, the primary latex particles, the colorant dispersion and the releasing agent dispersion may be mixed, to which mixture an agglomerating agent at a pH level that may range from about 0.1 to about 2.0 may be added to thereby obtain a primary agglomerated toner having a particle size of 2.5 μm or less. According to an embodiment, the primary agglomerated toner may act as a core, to which a secondary latex may be added controlling the pH of the system to be between about 6 to about 8, for example. After the particle size of the resultant mixture is maintained constant for certain period of time, the temperature may be increased to about 90 to 98° C., and the pH level may be decreased to about 5 to 6 to thereby obtain the secondary agglomerated toner constituting a shell layer.

The agglomerating agent may include at least one salt selected from Si-containing metal salts and Fe-containing metal salts. The Si and Fe-containing metal salts may include, for example, polysilica iron.

The secondary latex may be obtained by polymerizing the at least one polymerizable monomer as described herein. The polymerization process may be an emulsion polymerization distribution process. As a result of the emulsion polymerization distribution process, the secondary latex particles may have a particle size of about 1 μm or less, for example, from about 100 to about 300 nm. The secondary latex may also include wax, which may be added in the secondary latex during the polymerization process.

The tertiary latex prepared by polymerizing the at least one polymerizable monomer described herein, may additionally be coated on the secondary agglomerated toner. By forming the shell layer using at least one latex selected from the secondary latex and the tertiary latex, the toner may exhibit high durability and/or better preservation characteristics during shipping and handling. In this case, a polymerization inhibitor may be further added to prevent formation of new latex particles. Starved-feeding conditions, for example, may be used to appropriately coat a monomer mixed solution on the toner.

The secondary agglomerated toner or tertiary agglomerated toner obtained as described above may be filtered to isolate toner particles. So isolated toner particles may be dried. Then, an external additive may be added to the dried toner, controlling the amount of charge applied, to thereby obtain the final dry toner.

The external additive may be, for example, silica or $TiO_2$. The amount of the external additive may be from about 1.5 to about 7 parts by weight, or about 2 to about 5 parts by weight, based on 100 parts by weight of toner prior to the addition of the external additive. If the amount of the external additive is within the above ranges, caking of the toner may be prevented (caking is a phenomenon in which the toner particles may be attached to each other due to the agglomerating force). In addition, by controlling the proper amount of the external additive, the roller contaminations that may result from excessive external components may be mitigated.

An imaging method according to an embodiment of the present disclosure may includes the steps of a) attaching toner to a surface of a photoreceptor on which an electrostatic latent image is formed so as to form a visible image; and b) transferring the visible image onto a transfer medium. The toner may includes latex, a colorant and a releasing agent, and may further include S, Fe and Si. The [S]/[Fe] ratio may be from about $5.0\times10^{-4}$ to about $5.0\times10^{-2}$. The [Si]/[Fe] ratio may be from about $5.0\times10^{-4}$ to about $5.0\times10^{-2}$, The [S], [Fe] and [Si] denote the amounts of S, Fe and Si, respectively, measured by an X-ray fluorescence spectrometry.

In general, an electrophotographic imaging may include one or more of a charging process, an exposing process, a developing process, a transferring process, a fixing process, a cleaning process and a charge-removing process in order to form an image on a medium, for example, a sheet of paper.

During the charging process, a negative charge or a positive charge may be applied to a photoreceptor by, e.g., using a corona charger or a charging roller. During the exposing process, the charged surface of the photoreceptor is selectively discharged to form a latent image using an optical system such as, for example, a laser scanner or a diode arrangement. The latent image may be formed in such a manner that the latent image corresponds to the desired image to be formed on the final image receptor or medium (e.g., a sheet of paper). The optical system may use electromagnetic radiation, such as light, which may be, according to various embodiments, infrared light radiation, visible light radiation, or ultra-violet light radiation or a combination thereof.

During the developing process, the particles of the toner having a sufficient charge of a polarity are brought into contact with the latent image formed on the photoreceptor. Conventionally, a developing member having the same charge polarity as that of the toner, i.e. an electrically-biased developing member, may be used. Consequently, the toner particles may move toward the photoreceptor, and may selectively be attached to the latent image portion of the photoreceptor by an electrostatic force to thereby form the toner image on the photoreceptor.

During the transferring process, the toner image is transferred from the photoreceptor to the final image receptor, e.g., a sheet of paper, or the like. In some cases, as is known to those skilled in the art, an intermediate transferring element may be used to transfer the toner image from the photoreceptor to the final image receptor.

During the fixing process, the toner image on the final image receptor is heated so that the particles of the toner are softened or dissolved, and are fixed to the final image receptor. Alternatively, the toner image may be fixed to the final image receptor by compression at high pressure in lieu of or in addition to the application of the heat.

During the cleaning process, residual toner remaining on the photoreceptor is removed.

Finally, during the charge-removing process, the photoreceptor is exposed to light having a specific wavelength band to thereby reduced the charge of the photoreceptor to a uniformly low value. Thus, the residue of the latent image may be removed, making the photoreceptor available for a subsequent imaging cycle.

A toner supplying unit according to an embodiment of the present disclosure may include a toner tank for storing a supply of toner, a supplying part arranged to project inside the toner tank to discharge the toner from the toner tank and a toner agitating member rotatably disposed inside the toner tank. According to an embodiment, the toner agitating member is configured in such a manner to agitate the toner in almost an entire inner space of the toner tank, including the locations at the vicinity of the top surface of the supplying part. The toner used to develop an electrostatic latent image according to an embodiment may include latex, a colorant and a releasing agent, and may further include S, Fe and Si. The [S]/[Fe] ratio according to an embodiment may be from about $5.0\times10^{-4}$ to about $5.0\times10^{-2}$. The [Si]/[Fe] ratio according to an embodiment may be from about $5.0\times10^{-4}$ to about $5.0\times10^{-2}$. The [S], [Fe], and [Si] denote the amounts of S, Fe and Si, respectively, each of which may be measured by an X-ray fluorescence spectrometry.

For example, FIG. 1 shows a toner supplying apparatus 100 according to an embodiment of the present disclosure. The toner supplying apparatus 100 may include a toner tank 101, a supplying part 103, a toner-conveying member 105 and a toner-agitating member 110.

The toner tank 101 may store therein an amount of toner, and may be formed, for example, in a substantially hollow cylindrical shape. The supplying part 103 may be disposed at the bottom inner portion of the toner tank 101, and may operate to discharges the toner from stored the toner tank 101 out of the toner tank 101. For example, the supplying part 103 may be arranged at the bottom portion of the toner tank 101 so as to protrude into the toner tank 101, and may have, according to an embodiment, as shown in FIG. 1, a pillar shape with a semi-circular cross-section. The supplying part 103 may include a toner outlet (not shown) through which the toner is discharged out of the toner tank 101.

The toner-conveying member 105 may be disposed adjacent the supplying part 103 at the bottom portion of the toner tank 101. The toner-conveying member 105 may be formed as, for example, a coil shaped spring. An end of the toner-conveying member 105 may be received into the supplying part 103 so that, when the toner-conveying member 105 rotates, the toner in the toner tank 101 is conveyed to toward and into the supplying part 103 in the direction indicated by the arrow 'A.' The toner conveyed by the toner-conveying member 105 is discharged to the outside through the toner outlet of the supplying part 103.

The toner-agitating member 110 may be rotatably disposed inside the toner tank 101, and may operated to cause a movement of the toner in the toner tank 101 in a radial direction. For example, when the toner-agitating member 110 rotates in the middle of the toner tank 101, the toner particles in the toner tank 101 are agitated or stirred. That is, the toner particles may be carried by the toner-agitating member 110 from the bottom of the toner tank 101 to the top portion of the toner tank 101, and may fall downwards toward the bottom of the toner tank 101 by its own weight. Such movement of the toner particles may prevent the particles from solidifying or clumping together into lumps. The toner-agitating member 110 may include a rotation shaft 112 and a toner agitating film 120. The rotation shaft 112 may be rotatably disposed in the middle of the toner tank 101, and may have a driving gear (not shown) coaxially coupled with an end of the rotation shaft 112 projecting from a side of the toner tank 101. Thus, the rotation of the driving gear causes the rotation shaft 112 to rotate. The rotation shaft 112 may additionally have a wing plate 114 to help mounting the toner agitating film 120 to the rotation shaft 112. The wing plate 114 may be formed to be substantially symmetric about the rotation shaft 112. The toner agitating film 120 has a width that correspondingly spans the inner length of the toner tank 101.

According to an embodiment of the present disclosure, in order to affectively agitate the toner in the toner tank 101, and to prevent the toner from collecting and forming lumps in the vicinity of the top of the supplying part 103, the toner agitating film 120 may be made to be elastically deformable. For example, the toner agitating film 120 may be capable of bending when interfered by a projection inside the toner tank 101, e.g., the supplying part 103. Further, according to an embodiment, the toner agitating film 120 may be cut to form a first agitating part 121 and a second agitating part 122 so as to allow the first agitating part 121 to agitate the toner at the vicinity of the top surface the supplying part 103 in better conformity with the surface of the supplying part 103. The toner-agitating member 110 of the configuration described above may thus be capable of reaching substantially the entire inter volume of the toner tank 101, including the top surface of the supplying part 103.

An imaging apparatus according to an embodiment of the present disclosure may include an image carrier an image forming unit that forms an electrostatic latent image on a surface of the image carrier a toner receiving unit receiving a supply of toner therein, a toner supplying unit that supplies the toner onto the surface of the image carrier to develop the electrostatic latent image on the surface of the image carrier into a toner image and a toner transferring unit that transfers the toner image to a medium from the surface of the image carrier. The toner may include a latex, a colorant and a releasing agent, and may further include S, Fe and Si. The [S]/[Fe] ratio may be from about $5.0\times10^{-4}$ to about $5.0\times10^{-2}$. The [Si]/[Fe] ratio may be from about $5.0\times10^{-4}$ to about $5.0\times10^{-2}$. The [S], [Fe] and [Si] denote the amounts of S, Fe and Si, respectively, each of which may be measured by an X-ray fluorescence spectrometry.

Figure 2:
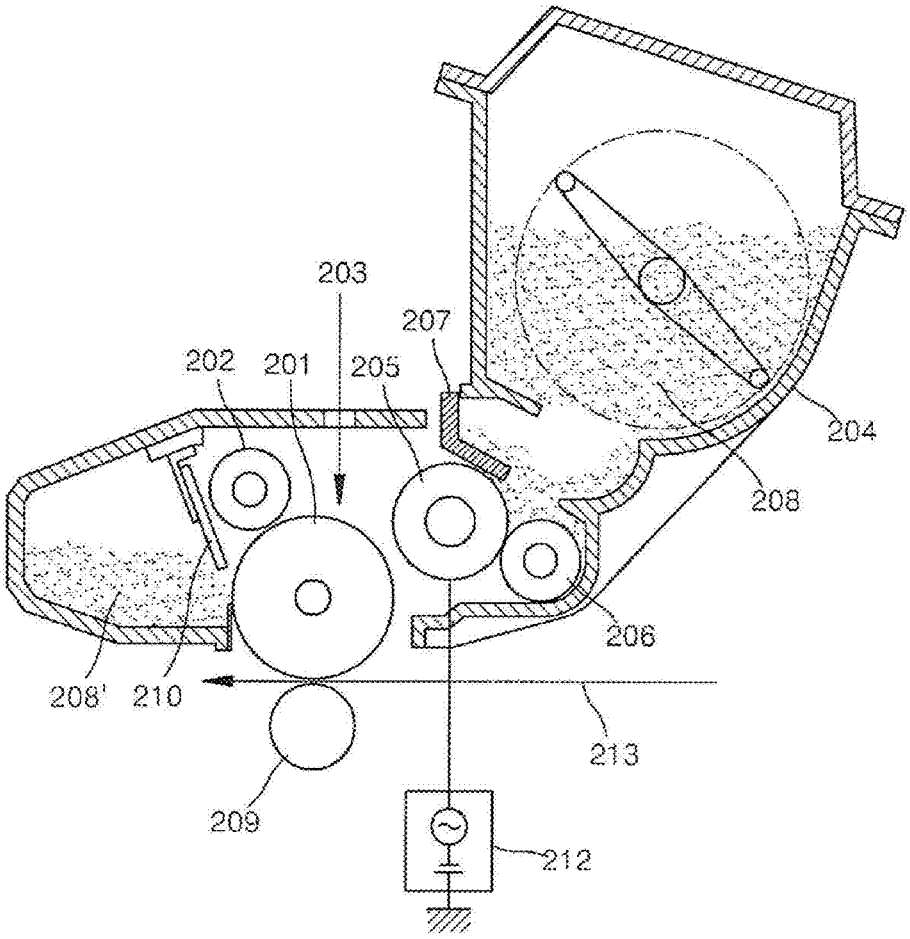
FIG. 2 is a schematic view of an imaging apparatus including a toner manufactured according to an embodiment of the present disclosure.

FIG. 2 shows an example of a non-contact development type imaging apparatus including toner prepared using a method according to an embodiment of the present disclosure.

In a developing device 204, a nonmagnetic one-component developer (for example, toner) 208 may be supplied to a developing roller 205 by a supply roller 206 that may be formed of an elastic material, such as polyurethane foam or sponge. The developer 208 supplied to the developing roller 205 may reach a contact portion between a developer controlling blade 207 and the developing roller 205 due to the rotation of the developing roller 205. The developer controlling blade 207 may be formed of an elastic material, such as, for example, metal or rubber. When the developer 208 passes through the contact portion between the developer controlling blade 207 and the developing roller 205, the developer 208 is formed into a thin layer, which may have a substantially uniform thickness, and which may be charged to certain potential level. So formed and charged layer of developer 208 is brought to a development region of a photoreceptor 201, which is an example of an image carrier, to develop the latent image being carried on the photoreceptor 201. The latent image is formed by exposing to a light 203 selective portions of a uniformly charged surface of the photoreceptor 201 to create a pattern of charge potential differences across the surface of the photoreceptor 201 corresponding to the intended image, and may thus be invisible prior to the development thereof.

The developing roller 205 may be arranged to face the photoreceptor 201 and to be spaced apart from the photoreceptor 201 by a predetermined distance. The developing roller and the photoreceptor 201 may be made rotate in rotational directions opposite to each other. For example, the developing roller 205 may be made to rotate in the counter-clockwise direction while the photoreceptor 201 is made to rotate in the clockwise direction.

The developer 208, which has been transferred to the development region of the photoreceptor 201, develops the latent image into visible form by an electrical or electrostatic force generated by the potential difference between the developing roller 205, to which a voltage that may include a direct current (DC) bias and/or alternating current (AC) voltage may be applied, and the latent potential of the photoreceptor 201. The developer 208 becomes transferred from the developing roller 205 to selective portions of the photoreceptor 201 according to the potential difference in the latent image so as to form a visible developer image on the photoreceptor 201. Prior to the formation of the latent image by exposure to the light 203, the surface of the photoreceptor 201 may be charged to a uniform potential by a charging unit 202 so as to provide a clean canvas on which the latent image can be drawn.

Subsequent to the development of the latent image, the developer 208, which has been transferred to the photoreceptor 201, reaches a transfer unit 209 due to the rotation direction of the photoreceptor 201, and is transferred from the photoreceptor 201 to a print medium 213 that passes between the photoreceptor 201 and the transfer unit 209, which may be, e.g., a roller to which a high voltage having a polarity opposite to the charged developer 208 may be applied. The residual charges remaining on the photoreceptor 201 may then be removed, for example, by a light exposure or by corona discharging subsequent to the transfer of the toner image to the print medium 213.

The print medium 213 carrying the transferred toner image may be made to pass through a high temperature and high pressure fusing device (not shown), causing the developer 208 of the toner image to be fused to the print medium 213 and to thereby complete the formation of the image. The non-developed, residual developer 208 remaining residual on the developing roller 205 may be collected by the supply roller 206 that contacts the developing roller 205. The non-transferred, residual developer 208' remaining residual on the photoreceptor 201 may be collected by a cleaning blade 210 into a waste developer container. The above-described image forming processes may be repeated as necessary to form additional images.

For further illustration of various aspects of the present disclosure, several specific examples will now be described. It should be understood however that these examples are for illustrative purposes only, and are not intended to limit the scope of the present disclosure.

EXAMPLES

SEM images of toners prepared according to the following examples may be obtained to identity shapes of the toners. The circularity of the toners can be measured, for example, using an SYSMEX FPIA-3000 using the equation below as previously described.

$$\text{Circularity}=2\times(\pi\times\text{area})^{0.5}/\text{circumference}.$$

The circularity may be from 0 to 1. As the circularity approaches 1, the toner particle shape becomes more circular.

Example 1

Synthesis of Primary Latex Particles 1,000 g of a polymerizable monomer mixed solution (styrene/n-butyl acrylate weight ratio of 75.3/24.7), 33 g of b-carboxyethylacrylate (Sipomer, Rhodia), 4.2 g of A-decandiol diacrylate constituting a crosslinker, 7.5 g of 1-dodecanethiol acting constituting a chain transfer agent (CTA), and 500 g of sodium dodecyl sulfate (Aldrich) aqueous solution (2% compared to water) constituting an emulsifier are added to a 3 L beaker, and the mixture is stirred to prepare a polymerizable monomer-emulsified solution. Separately, 18 g of ammonium persulfate (APS) constituting an initiator and 1,160 g of sodium dodecyl sulfate (Aldrich) aqueous solution (0.13% with respect to water) constituting an emulsifier are added to a 3 L double-jacketed reactor heated to a temperature of 75° C. While stirring the mixture including APS and sodium dodecyl sulfate, the prepared polymerizable monomer emulsified-solution is slowly dropped into the mixture for at least two hours. The reaction is performed for about 8 hours at this reaction temperature to obtain the primary latex particles. The particle size of the primary latex particles is measured by using a light scattering-type Horiba 910. The average particle size measured is from about 150 to about 200 nm. In this case, the toner concentration is 42.3%.

Preparation of Colorant Dispersion 10 g of an anionic reactive emulsifier (e.g., HS-10; Dai-Ichi Kogyo) and 60 g of cyan colorant are loaded into a milling bath, to which 400 g of glass beads having a diameter of 0.8 to 1 mm is added, and a milling operation is performed at room temperature, thereby obtaining a cyan colorant dispersion. The homogenizer used in this experiment is an ultrasonic homogenizer (e.g., VCX750 available from Sonic & Materials, Inc. of Newtown, Conn., U.S.A.).

Agglomeration and Preparation of Toner 30 g of a nitric acid (0.3 mol), and 15 g of 12% PSI-100 (available from Suido Kiko Kaisha, Ltd. of Tokyo, Japan) constituting an agglomerating, agent are added to a mixed solution including 500 g of de-ionized water, 150 g of the primary latex particles constituting a core, 35 g of 19.5% cyan colorant dispersion (HS-10 100%), and 28 g of 35% wax dispersion P-419 (available from Chukyo Yushi Co., Ltd. of Nagoya, Japan) in a 1 L reactor. The mixture is stirred using a homogenizer at a rate of 11,000 rpm for 6 minutes, thereby obtaining a primary agglomerated toner having a particle size of 1.5 to 2.5 μm. The resultant mixed solution is added to a 1 L double-jacketed reactor and the temperature is increased by 0.5° C. per minute from room temperature to 51.5° C. (e.g., a temperature equal to or higher than $T_g$−5 degree of latex). When the volume average diameter of the primary agglomerated toner reached about 6.3 μm, 50 g of a secondary latex, obtained by polymerizing polystyrene-based polymerizable monomers, is added thereto. When the volume average particle diameter of the reaction solution is from about 6.5 to 7.0 μm, NaOH (1 mol) is added to the reaction solution to control the pH level of the reaction solution to be about 7. When the volume average particle diameter is maintained constant for 10 minutes, the temperature is increased to 96° C. at a rate of 0.5° C./min. When the temperature is about 96° C., nitric acid (0.3 mol) is added to the reaction solution to control the pH level of the reaction solution to be about 5.7. The reaction may be performed for 3 to 5 hours to obtain a secondary agglomerated toner having potato-like shaped particles having a particle size of 6.5 to 7 μm. The agglomerated reaction solution may be cooled to a temperature lower than $T_g$, and a filtering operation is performed to isolate toner particles, which toner particles are then dried.

External additives are added to the toner by adding 0.5 parts by weight of NX-90 (available from Nippon Aerosil Co., Ltd. of Osaka, Japan), 1.0 parts by weight of RX-200 (Nippon Aerosil), and 0.5 parts by weight of SW-100 (available from Titan Kogyo, Ltd. of Ube, Japan) to 100 parts by weight of the dried toner particles. The mixture is stirred using a mixer (e.g., using a KM-LS2K available from Dae Hwa Tech Co., Ltd. of Busan, Korea) at a rate of 8,000 rpm for 4 minutes. The resultant toner has a volume average particle diameter from about 6.5 to about 7.0 μm. GSDp and GSDv of the final toner are 1.272 and 1.221, respectively. The circularity of the final toner is 0.972.

Example 2

Preparation of Toner

Toner is prepared in the same manner as in Example 1, except that 15 g of nitric acid (0.3 mol) and 15 g of PSI-025 (available from Suido Kiko Kaisha, Ltd. of Tokyo, Japan) constituting an agglomerating agent are used. GSDp and GSDv of the toner are 1.271 and 1.226, respectively. The circularity of the toner is 0.970.

Example 3

Preparation of Toner

Toner is prepared in the same manner as in Example 1, except that 5 g of a nitric acid (0.3 mol) and 15 g of PSI-200 (available from Suido Kiko Kaisha, Ltd.) constituting an agglomerating agent are used. GSDp and GSDv of the toner are 1.267 and 1.214, respectively. The circularity of the toner is 0.971.

Example 4

Preparation of Toner

Toner is prepared in the same manner as in Example 1, except that a black colorant is used instead of the cyan colorant. GSDp and GSDv of the toner are 1.265 and 1.221, respectively. The circularity of the toner is 0.973.

Example 5

Preparation of Toner

Toner is prepared in the same manner as in Example 1, except that 30 g of nitric acid (0.3 mol) and 15 g of PSI-100 (available from Suido Kiko Kaisha, Ltd.) are used as an agglomerating agent. GSDp and GSDv of the toner are 1.294 and 1.257, respectively. The circularity of the toner is 0.971.

Example 6

Preparation of Toner

Toner is prepared in the same manner as in Example 1, except that polyaluminum chloride (PAC), 6 g of a nitric acid (0.3 mol) and 3 g of PSI-100 (available from Suido Kiko Kaisha, Ltd.) are used as the agglomerating agent. GSDp and GSDv of the toner are 1.274 and 1.227, respectively. The circularity of the toner is 0.971.

Comparative Example 1

Toner is prepared in the same manner as in Example 1, except that PAC, 3 g of a nitric acid (0.3 mol) and 1.4 g of PSI-100 (available from Suido Kiko Kaisha, Ltd.) are used as an agglomerating agent. GSDp and GSDv of the toner are 1.260 and 1.213, respectively. The circularity of the toner is 0.972.

Comparative Example 2

Toner is prepared in the same manner as in Example 1, except that PAC is used as an agglomerating agent. GSDp and GSDv of the toner are 1.279 and 1.216, respectively. The circularity of the toner is 0.970.

Comparative Example 3

Toner is prepared in the same manner as in Example 1, except that 25 g of sodium hydroxide (1.0 mol) and 75 g of PSI-025 (available from Suido Kiko Kaisha, Ltd.) acting as an agglomerating agent are used. GSDp and GSDv of the toner are 1.369 and 2.953, respectively. The circularity of the toner is 0.965.

Comparative Example 4

Toner is prepared in the same manner as in Example 1, except that 0.80 g of PSI-025 (available from Suido Kiko Kaisha, Ltd.) is used as an agglomerating agent. GSDp and GSDv of the toner are 1.509 and 1.312, respectively. The circularity of the toner is 0.975.

Example 8

Toner Evaluation

X-ray Fluorescence Measurement

An X-ray fluorescence measurement of each of the samples is performed using an energy dispersive X-ray spectrometer (EDX-720 available from Shimadzu Corporation of Kyoto, Japan). The X-ray tube voltage is 50 kV, and the amounts of samples that are molded are 3 g±0.01 g. For each sample, the [S]/[Fe] and [Si]/[Fe] ratios are calculated using the amounts obtained by the X-ray fluorescence measurement and the intensity (unit: cps/uA).

Unpleasant Odor Evaluation 10 female and male adults participated in a blind unpleasant odor test to evaluate the samples. Each of the samples is loaded in an amount of about 10 g into a 50 mL container, and the container is sealed and placed in an oven at a temperature of 42° C. for 2 hours. The heated container is cooled to room temperature (about 25° C.), and the test is performed. The 50 mL container is opened in an NN (room temperature and room humidity)-environment lab. (◎ denotes a case in which no one sensed the unique unpleasant odor of a S compound; ○ denotes a case in which 1-3 of the participants managed to sense the unique unpleasant odor of a S compound; Δ denotes a case in which 4-7 of the participants easily sensed the unique unpleasant odor of a S compound; and x denotes a case in which most participants (8-10) easily sensed the unique unpleasant odor of a S compound)

◎: No problems occurred when used.

○: Although no problems occurred when used, toner quality was lower than that of ◎.

Δ: Unpleasant odor was generated under particular circumstances.

x: Cannot be used.

Agglomeration Evaluation

In consideration of the toner particle diameter distribution and unreacted (un-agglomerated) latex, this test is performed before external additives are added. Agglomeration evaluation conditions are as follows: the amount of un-agglomerated latex is determined according to a degree of transparency of a cleansing solution after the cleansing solution is used for cleansing the prepared toner. When the cleansing solution is transparent, such that a bottom of a container containing the cleansing solution could be seen, it is determined that no residual latex existed. When the cleansing solution is not transparent, such that a bottom of a container containing the cleansing solution could not be seen, it is determined that the residual latex existed in small amounts.

◎: each of GSDv and GSDp was 1.30 or less, and no un-agglomerated latex existed

○: each of GSDv and GSDp was 1.30 or less, and the un-agglomerated latex existed in small amounts Δ: at least one of GSDv and GSDp was greater than 1.30, and no un-agglomerated latex existed x: at least one of GSDv and GSDp was greater than 1.30, and the un-agglomerated latex existed in small amounts

TABLE 2

| | Type of Agglomerating agent | pH when Agglomerating agent is added | X-ray Fluorescence measurement results [S]/[Fe] | [Si]/[Fe] | Unpleasant Odor Evaluation | Agglomeration Evaluation |
|---|---|---|---|---|---|---|
| Example 1 | PSI-100 | 0.79 | $6.2 \times 10^{-3}$ | $4.1 \times 10^{-3}$ | ◎ | ◎ |
| Example 2 | PSI-025 | 1.07 | $3.4 \times 10^{-3}$ | $1.9 \times 10^{-3}$ | ◎ | ◎ |
| Example 3 | PSI-200 | 1.33 | $1.02 \times 10^{-2}$ | $7.4 \times 10^{-3}$ | ◎ | ◎ |
| Example 4 | PSI-100 | 0.82 | $7.3 \times 10^{-3}$ | $5.2 \times 10^{-3}$ | ◎ | ◎ |
| Example 5 | PSI-100 | 0.80 | $3.2 \times 10^{-2}$ | $2.1 \times 10^{-2}$ | ◎ | ◎ |
| Example 6 | PAC + PSI-100 | 0.83 | $1.3 \times 10^{-3}$ | $8.0 \times 10^{-4}$ | ○ | ◎ |
| Comparative Example 1 | PAC + PSI-100 | 0.85 | $6.4 \times 10^{-2}$ | $4.0 \times 10^{-2}$ | Δ | ◎ |
| Comparative Example 2 | PAC | 0.96 | — | — | X | ◎ |
| Comparative Example 3 | PSI-025 | 2.90 | $6.0 \times 10^{-4}$ | $3.9 \times 10^{-4}$ | ◎ | Δ |
| Comparative Example 4 | PSI-025 | 1.04 | $6.2 \times 10^{-2}$ | $3.9 \times 10^{-2}$ | X | X |

Referring to Table 2, when the toners for developing an electrostatic latent image manufactured according to Examples 1 to 6 each having a [S]/[Fe] ratio ranging from about $5.0\times10^{-4}$ to about $5.0\times10^{-2}$ and a [Si]/[Fe] ratio that ranges from about $5.0\times10^{-4}$ to about $5.0\times10^{-2}$ did not cause problems in the unpleasant odor evaluation. As discussed previously, the respective amounts of S, Fe and Si, i.e., [S], [Fe] and [Si], were measured by an X-ray fluorescence spectrometry.

However, when the [S]/[Fe] ratio is outside the range described above, and/or the [Si]/[Fe] ratio is outside the range described above, that is, the toners manufactured according to Comparative Examples 1, 2 and 4, the toners produced an unpleasant odor. With regard to Comparative Example 3, an unpleasant odor is not emitted because Fe is used in excessive amounts. However, since the agglomerating agent is used in excessive amounts, the toner particle diameter distribution may be wider, or the agglomeration characteristics of the toner may be degraded. For example, the amount of the residual un-agglomerated latex may be increased. Thus, despite the absence of an unpleasant odor, the toner manufactured according to Comparative Example 3 may not be suitable for use as a toner.

As described herein, according to the embodiments of the present disclosure, a toner that does not generate an unpleasant odor while maintaining other properties of the toner can be manufactured.

While the present disclosure has been particularly shown and described with reference to several embodiments thereof, it will be understood by those of ordinary skill in the art that various changes in form and details may be made thereto without departing from the principles and spirit of the present disclosure, the proper scope of which is defined in the following claims and their equivalents.

What is claimed is:

1. A toner comprising a latex, a colorant, and a releasing agent, wherein the toner further comprises sulfur (S), iron (Fe) and silicon (Si), wherein the [S]/[Fe] ratio is in the range of about 5.0.times.10.sup.−4 to about 5.0.times.10.sup.−2, wherein the [Si]/[Fe] ratio is in the range of about 5.0.times.10.sup.−4 to about 5.0.times.10.sup.−2, and wherein [S], [Fe] and [Si] denote respectively the amounts of S, Fe and Si each measured using an X-ray fluorescence spectrometry.

2. The toner of claim 1, wherein each of [S] and [Fe] is in the range of about 3 to about 30,000 ppm.

3. The toner of claim 1, wherein the releasing agent comprises a mixture of a paraffin-based wax with an ester-based wax; or an ester group-containing paraffin-based wax.

4. The toner of claim 3, wherein the releasing agent comprises a mixture of a paraffin-based wax and an ester-based wax, and wherein the amount of the ester-based wax is in the range of about 5 to about 39 parts by weight % based on the total weight of the releasing agent.

5. The toner of claim 1, wherein the toner has an average particle diameter in the range of about 3 to about 8.mu·m.

6. The toner of claim 1, wherein the toner has an average circularity in the range of about 0.940 to about 0.990.

7. The toner of claim 1, wherein the toner has a volume average particle diameter distribution coefficient (GSDv) of about 1.30 or less and a number average particle diameter distribution coefficient (GSDp) of about 1.30 or less.

* * * * *